United States Patent [19]

Sernaker

[11] 4,439,202

[45] Mar. 27, 1984

[54] EMBROIDERED TRANSFER AND METHOD OF MAKING SAME

[75] Inventor: Howard Sernaker, Wynnewood, Pa.

[73] Assignee: Virginville Patents, Inc., Virginville, Pa.

[21] Appl. No.: 916,018

[22] Filed: Jun. 15, 1978

[51] Int. Cl.[3] ..... D06P 1/16; D06P 1/18; D06P 3/36

[52] U.S. Cl. ..... 8/471; 428/187

[58] Field of Search ..... 8/2.5 R, 2.5 A, 3, 471; 112/266, 439, 266.1; 2/246; 428/187

[56] References Cited

U.S. PATENT DOCUMENTS

| | | | |
|---|---|---|---|
| 3,657,060 | 4/1972 | Haigh | 428/488 |
| 3,868,214 | 2/1975 | Schackleton | 8/2.5 A |
| 3,961,388 | 6/1976 | Jaffa | 8/2.5 R |
| 3,974,010 | 8/1976 | Cox | 112/439 |
| 3,994,250 | 11/1976 | Norris | 112/266 |
| 4,018,557 | 4/1977 | Glover | 8/2.5 A |
| 4,046,936 | 9/1977 | Schachter | 8/2.5 A |
| 4,071,387 | 1/1978 | Schlaepfer | 428/187 |
| 4,092,451 | 5/1978 | Sernaker | 112/266 |

FOREIGN PATENT DOCUMENTS

| | | | |
|---|---|---|---|
| 1243223 | 8/1971 | United Kingdom | 8/2.5 A |

OTHER PUBLICATIONS

Kleeberg, I. C. ed. *The Butterick Fabric Handbook,* Butterick Publishing, N.Y., 1975, pp. 99, 100, 119–121 and 142.

Vellins, C. E., British Knitting Industry, vol. 46, 524, Jan. 1973, p. 69.

Miles, L. W. C., Jour. Soc. Dyers & Colorists, May 1977, pp. 161–163.

*Primary Examiner*—Maria Parrish Tungol

*Attorney, Agent, or Firm*—Michael F. Petock

[57] ABSTRACT

The embroidered transfer includes a pattern embroidered with thread of one color on a substrate in a manner so that a portion of the pattern is sculptured. The pattern is at least in part colored and outlined by transfer printing a dye stuff onto the pattern in registration therewith on the warp side of the pattern. Adhesive is applied to the shuttle side of the pattern.

20 Claims, 3 Drawing Figures

FIG. 1
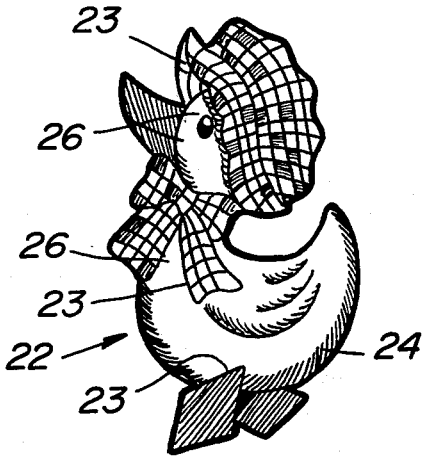
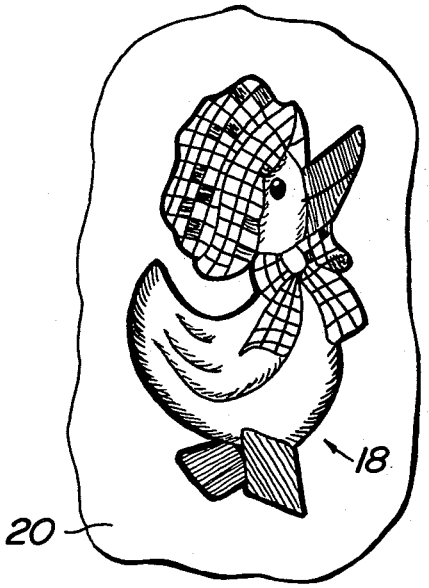
FIG. 2
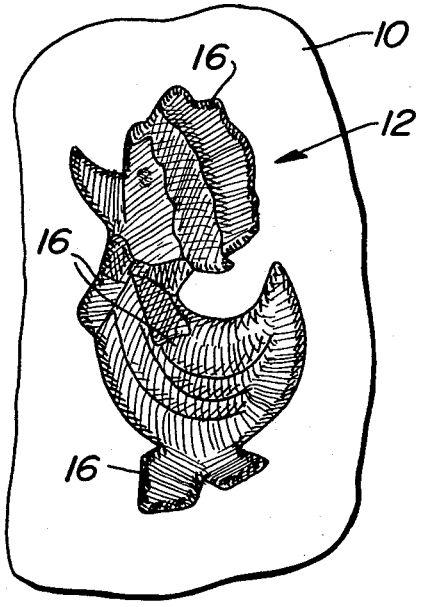
FIG. 3

EMBROIDERED TRANSFER AND METHOD OF MAKING SAME

BACKGROUND

Embroidered transfers are generally made by stitching a pattern with different colored threads onto a substrate. Each time the color of the threads is changed, the apparatus must be shut down. The shut down time when changing from one color thread to another is generally approximately 45 minutes. When an embroidered transfer is comprised of a large number of colors such as five or six colors, it would be appreciated that the apparatus downtime takes several hours.

Printing from a paper strip onto fabric is well known. The details with respect to printing with a dye stuff on fabric are disclosed in U.S. Pat. No. 2,911,280 and the disclosure therein is incorporated herein by reference. U.S. Pat. No. 3,868,214 discloses a process for compressing material to form embossments and then a dye stuff is printed on the uncompressed portions which project through a stencil. U.S. Pat. 3,874,846 teaches contact printing on both faces of grey goods and then embossing the fabric web to provide a surface texture compatible with the pattern. While each of said patents teaches printing of a dye stuff on a fabric, none of said patents teaches the advantages and unexpected features of the present invention wherein the fabric being printed is a pattern embroidered with white thread in a manner so that a portion of the pattern is sculptured.

SUMMARY OF THE INVENTION

The embroidered transfer of the present invention has a pattern embroidered with thread of one color so that at least a portion of the pattern is sculptured on the warp side thereof. At least a portion of the embroidered pattern is printed with at least two colors on the warp side. An adhesive is provided on the shuttle side of the embroidered pattern is desired.

The pattern of the present invention is preferably made by embroidering a pattern with a synthetic white thread on a substrate in a manner so that a portion of the pattern is sculptured. A transfer print is provided on paper with a dye stuff of at least two different colors and wherein the dye stuff will transfer by sublimation under heat and pressure or vacuum. The print is registered with the pattern and then color is printed onto the pattern while applying heat and pressure or vacuum. An adhesive is applied to the shuttle side of the pattern if desired.

It is an object of the present invention to provide multi-colored embroidered patterns having a sculptured effect and wherein the pattern is more vivid and delineated while being less expensive than embroidered transfers proposed heretofore.

It is an object of the present invention to provide a multi-colored embroidered pattern which is made in a manner which minimizes downtime and minimizes the number of persons needed to produce the embroidered transfer.

Other objects will appear hereinafter.

For the purpose of illustrating the invention, there is shown in the drawings a form which is presently preferred; it being understood, however, that this invention is not limited to the precise arrangements and instrumentalities shown.

FIG. 1 is a plan view of an embroidered transfer in accordance with the present invention.

FIG. 2 is a plan view of a transfer print.

FIG. 3 is a plan view of a strip of fabric showing the embroidered pattern thereon.

Referring to the drawings in detail, wherein like numerals indicate like elements, there is shown in FIG. 3 a substrate 10 on which has been embroidered a pattern 12. The substrate 10 is preferably a base cloth as is conventionally used in connection with an aetzing process. The pattern 12 is preferably embroidered on the fabric 10 using a schiffli machine using thread of one color. The thread is preferably a white polymeric plastic material such as a polyester which has been bleached to remove any needle oil on the thread. Other synthetic thread which may be used is nylon and acrylics. Thread of natural material such as cotton may be used provided that such cotton thread is processed to remove or disperse natural oils in the cotton fiber. A sculptured effect is obtained on a portion of the pattern 12 by stitching over previous stitches referred to as a underlaying so as to have raised areas 16 as indicated by the stitch lines in FIG. 3 with the remaining area representing stitches at a lower elevation and lacking any underlaying or being unstitched areas.

When the substrate 10 is a fabric as conventionally used in connection with an aetzing process, the fabric 10 may be separated from the embroidered pattern 12 and removed by either the wet or dry process. In connection with a wet process, the finished embroidery and fabric 10 are placed in a bath of hot concentrated caustic soda solution which burns out the fabric 10 thereby leaving the embroidered pattern 12. In the dry process, the fabric 10 is removed by passing the same through a gas oven heated to about 225° F. which burns out or chars the material 10 thereby making it brittle. In accordance with the present invention, the fabric 10 is removed by the aetzing process using either the wet or dry process. If desired, the pattern 12 can be separated from the substrate 10 by die cutting fabric 10 around the periphery of pattern 12.

Colored prints 18 which may be made using known lithographic or photographic techniques are provided on pieces of thin flexible paper 20 with the prints corresponding to the peripheral contour and portions of the pattern 12 to be colored. Print 18 is a mirror image of pattern 12. Such printing paper prints are per se old in the art and well known to those skilled in the art as per the aforementioned U.S. patents. The print 18 is superimposed over the pattern 12 which has now been separated from the fabric 10 and registered therewith. The print 18 is preferably made with a slightly larger contour to facilitate ease of registration and to be certain that no portions of the pattern 12 will be inadvertently not dyed. The color of the print is defined by a dye stuff which may be a dye or an ink which sublimes under heat and pressure or vacuum.

The preferred dye stuff for polyester thread is commercially available as a transfer ink from Sinclair & Valentine, 5220 Umbria Street, Philadelphia, Pa. and sublimes at about 400° F. Heat changes the dye stuff to a gas. Pressure or vacuum is applied to the paper to transfer the dye stuff in the form of a gas to the pattern 12. The dye stuff colors predetermined areas on the sculptured part of pattern 12 which may or may not be the entire embroidered pattern 12 and simultaneously outlines portions thereof. The dye stuff is absorbed by the threads of pattern 12.

As shown in FIG. 1, the embroidered transfer 22 has outline 23 defining portions of the figure as well as color applied to predetermined portions of the figure. In addition, a different shade of color is applied at 24 where it is intended to illustrate roundness of the object in conformity with the sculptured effect of the pattern. Other light colors are applied as at area 26 to provide highlights. The highlight areas 26 can be obtained by leaving exposed the white threads of pattern 12. As a result thereof, there is provided an embroidered transfer 22 with a sculptured effect and printed in vibrant colors in addition to outlines and shading. The greater the number of colors in transfer 22, the more efficient it is to produce the embroidered transfer of the present invention.

Heretofore, embroidered emblems having six or more colors were considered the upper limit of what could be produced commercially and inexpensively in accordance with a conventional process wherein the colors are applied by different colored thread. The embroidered patterns of the present invention are not so limited and require only one operator whereas previous methods required as many as six operators. The present invention offers the option of using either the wet or the dry method for aetzing or by use of die cutting. The present invention provides a more realistic outline to portions of the figure particularly in connection with lettering. Thus, if the figure had its name printed thereon, the printing would be that comparable with printing on paper as compared with previous methods wherein the printing is in the form of stitches which are raggedy particularly with letters of the alphabet which have a curve forming a part thereof such as the letter "C".

With the print applied to the warp side of the embroidered pattern 12, there is provided a transfer 22 which may be secured to any fabric by stitching or by an adhesive applied to the shuttle side. The adhesive is preferably a thermoplastic adhesive which will facilitate attaching the embroidered transfer 22 to a fabric such as an article of wearing apparel, bedspread, etc. upon application of heat and pressure. A wide variety of adhesive may be utilized. The preferred adhesive is a transparent or translucent polymeric thermoplastic material applied in a layer not thicker than about 0.007 inch and having a melting temperature of about 300° F. which temperature is lower than the sublimation temperature of the dye stuff and lower than the melting temperature of the thread material from which the pattern 12 is embroidered. The preferred adhesive is FUS-A-BON which is commercially available from General Fabric Fusing, Cincinnati, Ohio.

In the illustrated embodiment, the object is a fanciful animal having an irregular peripheral contour. The object in FIG. 1 has a hat and scarf defined by a checkerboard pattern in four different colors. Each rectangle of the checkerboard pattern is a solid color and the rectangle has sides which are approximately 1/16 of an inch long. A checkerboard pattern of this nature would be extremely expensive if it was made on a schiffli mchine but is easily and inexpensively made by printing onto pattern 12.

The prior embroidered patterns were limited to flat color and line art of one dimension. The present invention produces embroidered patterns having a three-dimensional effect and is limited only to the extent of what can be printed by photographically reproduced lithograph techniques. The embroidered patterns 22 are more life-like in appearance with a surface appearance suitable to the subject matter thereof. Thus, furry animals look furry and metal looks hard.

The present invention may be embodied in other specific forms without departing from the spirit or essential attributes thereof and, accordingly, reference should be made to the appended claims, rather than to the foregoing specification, as indicating the scope of the invention.

I claim:

1. A method of making an embroidered transfer or emblem comprising the steps of:
   (a) embroidering a pattern on a portion of a substrate while using thread free from oil and with said thread being of a single color and in an amount so that a portion of the pattern is sculptured by having a greater thickness than another portion of the pattern,
   (b) separating the pattern and its associated substrate portion from the remainder of the substrate,
   (c) providing a transfer print on paper with a dyestuff of at least two different colors and capable of subliming under heat and pressure or vacuum,
   (d) registering portions of the print with mating portions of said pattern,
   (e) transferring color from said print as a gas to the warp side of the pattern while applying sufficient heat to sublime said dyestuff.

2. A method in accordance with claim 1 including applying a thermoplastic adhesive to the shuttle side of the thusly printed pattern, using as said adhesive a material whose melting temperature is less than the sublimation temperature of said dye stuff and less than the melting temperature of said thread.

3. A method in accordance with claim 1 wherein said pattern is embroidered on an aetz fabric used as the substrate, and then aetzing said fabric by one of the wet and dry processes to accomplish said separating step.

4. A method in accordance with claim 1 wherein said thread is white and made from a material selected from the group of polyesters, nylons, and acrylics.

5. A method in accordance with claim 1 wherein said transfer step includes applying shading and outline delineation of portions of the pattern using at least four different colors.

6. A method in accordance with claim 1 wherein said transfer step includes at least in part applying letters of the alphabet to said pattern.

7. An embroidered transfer emblem comprising an embroidered pattern on one side of a substrate whose size corresponds to the size of the pattern with (of) thread of a single color which is free of needle oil, portions of the pattern having a sculptured effect by an increased number of thread stitches, at least two colors of dyestuff printed on the thread stitches defining said portions and on other portions of the pattern, said colors being in registry with said sculptured portions of said pattern with at least one of said printed portions including printing outlining a configuration on a portion of said pattern, and said colors being printed on the warp side of said pattern.

8. An article in accordance with claim 7 including an adhesive on the shuttle side of said pattern, said adhesive being a thermoplastic having a melting temperature lower than the melting temperature of said thread and below the sublimation temperature of said dye stuff.

9. An article in accordance with claim 7 wherein said pattern has an irregular peripheral contour and represents a fanciful animal.

10. An article in accordance with claim 7 wherein said single color is white, said thread being a synthetic thread selected from the group consisting of polyesters, nylons, and acrylics.

11. A method of making an embroidered transfer or emblem comprising the steps of:

(a) embroidering a pattern on a portion of a substrate while using thread of a single color and in an amount so that a portion of the pattern is sculptured by having a greater thickness than another portion of the pattern, (b) separating the pattern and its associated substrate portion from the remainder of the substrate, (c) providing a transfer print on paper with a dyestuff of at least two different colors and capable of subliming under heat and pressure or vacuum, (d) registering portion of the print with mating portions of said pattern, and (e) transferring color from said print as a gas to the warp side of the pattern while applying sufficient heat to sublime said dyestuff.

12. A method in accordance with claim 11 including applying a thermoplastic adhesive to the shuttle side of the thusly printed pattern, using as said adhesive a material whose melting temperature is less than the sublimination temperature of said dye stuff and less than the melting temperature of said thread.

13. A method in accordance with claim 11 wherein said pattern is embroidered in an aetz fabric used as the substrate, and then aetzing said fabric by one of the wet and dry processes to accomplish said separating step.

14. A method in accordance with claim 11 wherein said thread is white and made from a material selected from the group of polyesters, nylons and acrylics.

15. A method in accordance with claim 11 wherein said transfer step includes applying shading and outline delineation of portions of the pattern using at least four different colors.

16. A method in accordance with claim 11 wherein said transfer step includes at least in part applying letters of the alphabet to said pattern.

17. An embroidered transfer emblem comprising an embroidered pattern on one side of a substrate whose size corresponds to the size of the pattern with thread of a single color, portions of the pattern having a sculptured effect by an increased number of thread stitches, at least two colors of dye stuff printed on the thread stitches defining said portions and on other portions of the pattern, said colors being in registry with sculptured portions of said pattern with at least one of said printed portions including printing outlining a configuration on a portion of said pattern, and said colors being printed on the warp side of said pattern.

18. An article in accordance with claim 17 including an adhesive on the shuttle side of said pattern, said adhesive being a thermoplastic having a melting temperature lower than the melting temperature of said thread and below the sublimation temperature of said dye stuff.

19. An article in accordance with claim 17 wherein said pattern has an irregular peripheral contour and represents a fanciful animal.

20. An article in accordance with claim 17 wherein said single color is white, said thread being a synthetic thread selected from the group consisting of polyesters, nylons and acrylics.

* * * * *